US011585172B2

(12) United States Patent
Card

(10) Patent No.: US 11,585,172 B2
(45) Date of Patent: Feb. 21, 2023

(54) KICKOVER TOOL

(71) Applicant: Impact Selector International, LLC, Heath, TX (US)

(72) Inventor: Stuart Card, Dyce (GB)

(73) Assignee: Impact Selector International, LLC, Heath, TX (US)

( * ) Notice: Subject to any disclaimer, the term of this patent is extended or adjusted under 35 U.S.C. 154(b) by 0 days.

(21) Appl. No.: 17/305,424

(22) Filed: Jul. 7, 2021

(65) Prior Publication Data

US 2022/0010638 A1 Jan. 13, 2022

Related U.S. Application Data

(60) Provisional application No. 62/705,703, filed on Jul. 10, 2020.

(51) Int. Cl.
*E21B 23/03* (2006.01)
*E21B 43/12* (2006.01)

(52) U.S. Cl.
CPC ..... *E21B 23/03* (2013.01); *E21B 43/123* (2013.01)

(58) Field of Classification Search
CPC ..... E21B 23/03; E21B 43/123
See application file for complete search history.

(56) References Cited

U.S. PATENT DOCUMENTS

| | | | | |
|---|---|---|---|---|
| 3,788,397 | A | 1/1974 | Terral et al. | |
| 3,827,490 | A * | 8/1974 | Moore, Jr. | E21B 23/03 166/117.5 |
| 4,051,895 | A | 10/1977 | Embree | |
| 4,452,305 | A * | 6/1984 | Schwendemann | E21B 23/03 166/381 |
| 4,976,314 | A * | 12/1990 | Crawford | E21B 23/03 166/117.5 |
| 9,140,086 | B2 * | 9/2015 | Hall | E21B 23/03 |
| 9,574,404 | B2 * | 2/2017 | Tunget | E21B 17/00 |

OTHER PUBLICATIONS

PCT/US2021/070839 International Preliminary Report on Patentability dated Feb. 16, 2022, 6 pages.
PCT/US2021/070839 Written Opinion of the ISA and International Search Report dated Oct. 4, 2021, 11 pages.

* cited by examiner

*Primary Examiner* — Jonathan Malikasim
(74) *Attorney, Agent, or Firm* — Boisbrun Hofman, PLLC

(57) ABSTRACT

A downhole tool for installing a gas lift valve in a well. The downhole tool may include a housing, a mandrel movably disposed with respect to the housing, a holder configured to hold the gas lift valve, and an arm supporting the holder. The arm may pivot between a retracted position in which the holder is adjacent the housing and an extended position in which the holder is disposed away from the housing. The mandrel and the arm may be operatively connected via a pin-slot joint having a pin disposed within a slot. The slot may have a first slot portion and a second slot portion. The pin-slot joint may prevent the arm from pivoting when the pin is within the first slot portion and permit the arm to pivot when the pin is within the second slot portion.

20 Claims, 6 Drawing Sheets

KICKOVER TOOL

CROSS-REFERENCE TO RELATED APPLICATIONS

This application claims priority to and the benefit of U.S. Provisional Application No. 62/705,703, titled "KICKOVER TOOL," filed Jul. 10, 2020, the entire disclosure of which is hereby incorporated herein by reference.

BACKGROUND OF THE DISCLOSURE

Oil and gas wells are drilled into Earth's surface or ocean bed to recover natural deposits of oil, gas, and materials that are trapped within subterranean geological formations. After a wellbore is drilled, a metal casing may be inserted therein and secured via cement, such as to protect the sidewall of the wellbore, isolate different geological formations, and maintain control of formation fluids and well pressure during various subsequent downhole operations. Thereafter, additional metal tubular strings may be inserted within the wellbore to facilitate delivery of treatment fluid downhole and transfer formation fluid to the surface. After the well is completed, various intervention operations may be performed to repair and maintain the well or otherwise optimize well productivity.

During production operations, when reservoir pressure is insufficient to force hydrocarbons from a subterranean reservoir to the wellsite surface, gas may be injected into a production tubing string to reduce density of the hydrocarbons located within. When density of the hydrocarbons is reduced, the reservoir pressure may then be sufficient to raise the column of hydrocarbons within the production tubing to the wellsite surface. The gas may be conveyed downhole along an annulus between the casing and production tubing and injected into the production tubing via a plurality of gas lift valves positioned along the production tubing. Each gas lift valve may be installed within a side pocket of a corresponding side pocket mandrel connected along the production tubing.

A kickover tool is used to install and retrieve a gas lift valve into and from a side pocket of a gas lift mandrel. The kickover tool comprises gas lift valve holder configured to grab and hold a gas lift valve. The kickover tool is conveyed downhole into a gas lift mandrel adjacent its side pocket. The holder is then extended laterally into the side pocket to install a new gas lift valve within the side pocket or retrieve an old gas lift valve from the side pocket. The kickover tool further comprises a holder displacement mechanism that engages a trigger recess along the side pocket mandrel and moves the holder into alignment with the side pocket. During operations, the kickover tool is conveyed into the gas lift mandrel past the trigger recess and then pulled uphole until a latch of the displacement mechanism engages the recess. Thereafter, an uphole pull of the kickover tool operates the displacement mechanism, causing the holder to be moved laterally into the side pocket. The kickover tool is then lowered downhole to install a new gas lift valve into the side pocket or grab an old gas lift valve installed within the side pocket. Current holder displacement mechanisms are complicated and, thus, more susceptible to malfunctions. Current holder displacement mechanisms also require special tools and/or partial disassembly to permit such holder displacement mechanisms to be reset to their retracted position.

SUMMARY OF THE DISCLOSURE

This summary is provided to introduce a selection of concepts that are further described below in the detailed description. This summary is not intended to identify indispensable features of the claimed subject matter, nor is it intended for use as an aid in limiting the scope of the claimed subject matter.

The present disclosure introduces an apparatus comprising a downhole tool for installing a gas lift valve in a well, wherein the downhole tool comprises a housing, a mandrel movably disposed with respect to the housing, a holder configured to hold the gas lift valve, and an arm supporting the holder. The arm is operable to pivot between a retracted position in which the holder is adjacent the housing and an extended position in which the holder is disposed away from the housing. The mandrel and the arm are operatively connected via a pin-slot joint comprising a pin disposed within a slot. The slot comprises a first slot portion and a second slot portion. The pin-slot joint prevents the arm from pivoting when the pin is within the first slot portion. The pin-slot joint permits the arm to pivot when the pin is within the second slot portion.

The present disclosure also introduces an apparatus comprising a downhole tool for installing a gas lift valve in a well, wherein the downhole tool comprises a housing, a mandrel movably disposed with respect to the housing, a first biasing member, a second biasing member, an arm pivotably connected to the housing, and a holder connected to the arm and configured to hold the gas lift valve. The arm is operable to pivot between a retracted position in which the holder is adjacent the housing and an extended position in which the holder is disposed away from the housing. The mandrel and the arm are operatively connected via a pin-slot joint comprising a pin disposed within a slot. The slot comprises a first slot portion and a second slot portion. The first slot portion and the second slot portion extend at an angle with respect to each other. The first biasing member is operable to bias the mandrel and the housing toward a predetermined relative position causing the pin to be maintained within the first slot portion to thereby prevent the arm from pivoting from the retracted position to the extended position. The second biasing member is operable to pivot the arm from the retracted position to the extended position when the pin is within the second slot portion.

The present disclosure also introduces an apparatus comprising a downhole tool for installing a gas lift valve in a well, wherein the downhole tool comprises a housing, a mandrel movably disposed with respect to the housing, a holder configured to hold the gas lift valve, and an arm supporting the holder. The arm is operable to pivot between a retracted position in which the holder is adjacent the housing and an extended position in which the holder is disposed away from the housing. The arm comprises a slot having a first slot portion and a second slot portion. The mandrel comprises a pin disposed within the slot. The pin prevents the arm from pivoting from the retracted position to the extended position when the pin is within the first slot portion.

These and additional aspects of the present disclosure are set forth in the description that follows, and/or may be learned by a person having ordinary skill in the art by reading the material herein and/or practicing the principles described herein. At least some aspects of the present disclosure may be achieved via means recited in the attached claims.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
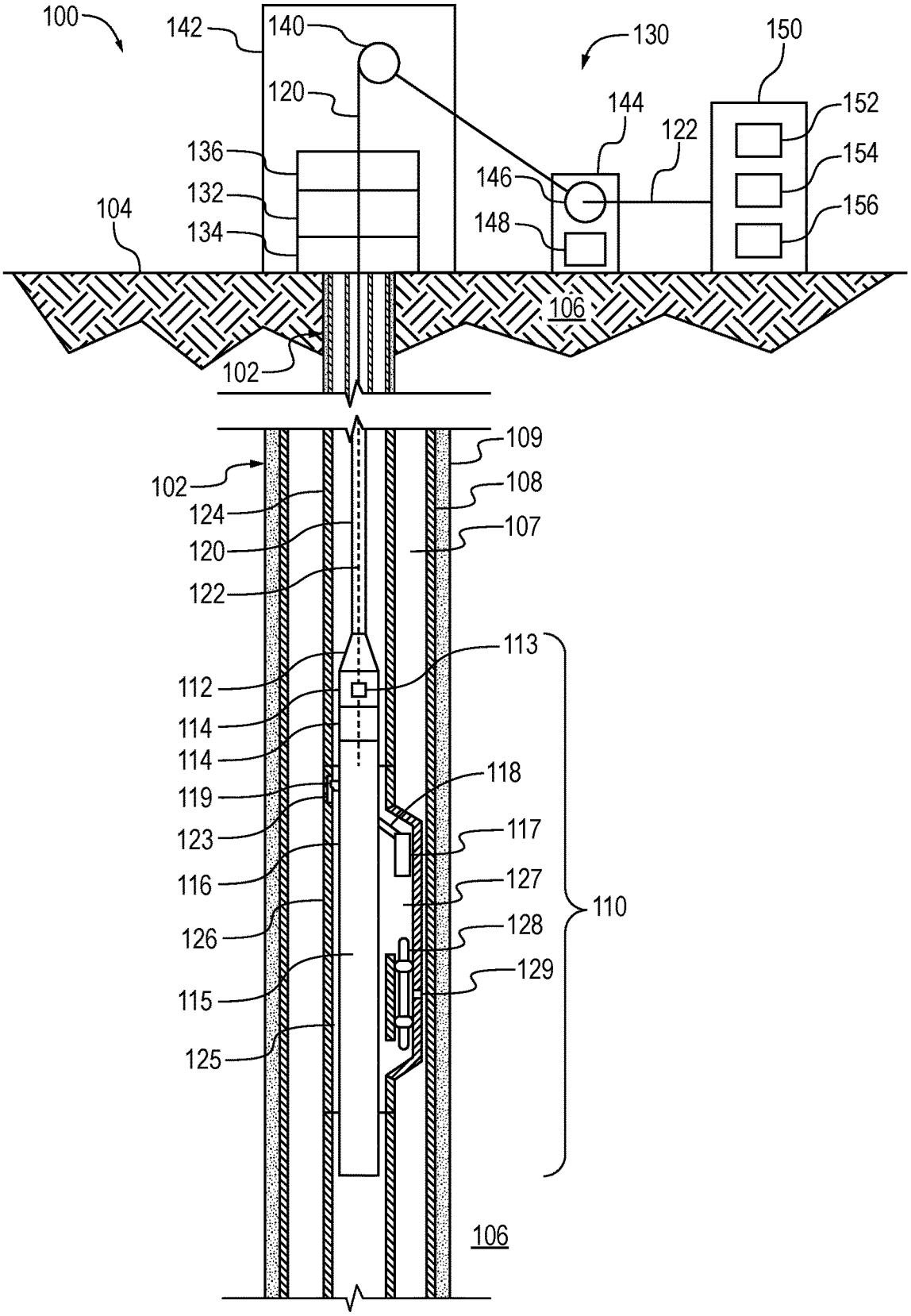
FIG. 1 is a schematic view of at least a portion of an example implementation of apparatus according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for simplicity and clarity, and does not in itself dictate a relationship between the various embodiments and/or configurations discussed. Moreover, the formation of a first feature over or on a second feature in the description that follows, may include embodiments in which the first and second features are formed in direct contact, and may also include embodiments in which additional features may be formed interposing the first and second features, such that the first and second features may not be in direct contact.

Terms, such as upper, upward, above, lower, downward, and/or below are utilized herein to indicate relative positions and/or directions between apparatuses, tools, components, parts, portions, members and/or other elements described herein, as shown in the corresponding figures. Such terms do not necessarily indicate relative positions and/or directions when actually implemented. Such terms, however, may indicate relative positions and/or directions with respect to a wellbore when an apparatus according to one or more aspects of the present disclosure is utilized or otherwise disposed within the wellbore. For example, the term upper may mean in the uphole direction, and the term lower may mean in the downhole direction.

FIG. 1 is a schematic view of at least a portion of an example implementation of a wellsite system 100 representing an example environment in which one or more aspects of the present disclosure may be implemented. The wellsite system 100 is depicted in relation to a wellbore 102 formed by rotary and/or directional drilling and extending from a wellsite surface 104 into a subterranean formation 106. The wellsite system 100 may be utilized to facilitate the recovery of oil, gas, and/or other materials that are trapped in the formation 106 via the wellbore 102. The wellbore 102 comprises a casing 108 secured by cement 109. It is noted that although the wellsite system 100 is depicted as an onshore implementation, it is to be understood that the aspects described below are also generally applicable or readily adaptable to offshore implementations.

The wellsite system 100 includes surface equipment 130 located at the wellsite surface 104 and a downhole intervention and/or sensor assembly, referred to as a tool string 110, conveyed within the wellbore 102 along one or more formations 106 via a conveyance means 120 operably coupled with one or more pieces of the surface equipment 130. The conveyance means 120 may be operably connected with a conveyance device 140 operable to apply adjustable downward and/or upward forces to the tool string 110 via the conveyance means 120 to convey the tool string 110 within the wellbore 102. The conveyance means 120 may be or comprise a cable, a wireline, a slickline, a multiline, an e-line, coiled tubing, and/or other conveyance means. The conveyance device 140 may be, comprise, or form at least a portion of a sheave or pulley, a winch, a drawworks, an injector head, and/or other device operable to guide and/or move the conveyance means 120 to thereby convey the tool string 110 within the wellbore 102. The conveyance device 140 may be supported above the wellbore 102 via a mast, a derrick, a crane, and/or other support structure 142. The surface equipment 130 may further comprise a reel or drum 146 configured to store thereon a wound length of the conveyance means 120, which may be selectively wound and unwound by the conveyance device 140 to selectively convey the tool string 110 into, within, and out of the wellbore 102.

Instead of or in addition to the conveyance device 140, the surface equipment 130 may comprise a winch conveyance device 144 comprising or operably connected with the drum 146 and operable to selectively apply tension to the conveyance means 120 to convey the tool string 110 within the wellbore 102. The winch conveyance device 144 may comprise the drum 146 and a rotary actuator 148 (e.g., an electric motor) operatively connected to the drum 146. The rotary actuator 148 may rotate the drum 146 to selectively unwind and wind the conveyance means 120 to thereby apply an adjustable tensile force to the tool string 110 and, thus, selectively convey the tool string 110 into, within, and out of the wellbore 102.

The conveyance means 120 may comprise one or more metal support wires or cables configured to support the weight of the downhole tool string 110. The conveyance means 120 may also comprise one or more insulated electrical and/or optical conductors 122 operable to transmit electrical energy (i.e., electrical power) and/or electrical and/or optical signals (e.g., information, data, etc.) between the tool string 110 and one or more of the surface equipment 130, such as a power and control system 150. The conveyance means 120 may comprise and/or be operable in conjunction with means for communication between the tool string 110, the conveyance device 140, the winch conveyance device 144, and/or one or more other portions of the surface equipment 130, including the power and control system 150.

The wellbore 102 may be capped by a plurality (e.g., a stack) of fluid control devices 132, which may include fluid control valves, spools, and fittings individually and/or collectively operable to direct and control the flow of formation fluid out of the wellbore 102. The fluid control devices 132 may also or instead comprise a blowout preventer (BOP) stack operable to prevent the flow of the formation fluid out of the wellbore 102. The fluid control devices 132 may be mounted on a wellhead 134.

The surface equipment 140 may further comprise a sealing and alignment assembly 136 mounted on the fluid control devices 132 and operable to seal the conveyance line 120 during deployment, conveyance, intervention, and other wellsite operations. The sealing and alignment assembly 136 may comprise a lock chamber (e.g., a lubricator, an airlock, a riser, etc.) mounted on the fluid control devices 132 and a stuffing box operable to seal around the conveyance line 120, although such details are not shown in FIG. 1. The stuffing box may be operable to seal around an outer surface of the conveyance line 120, for example via annular packings applied around the surface of the conveyance line 120 and/or by injecting a fluid between the outer surfaces of the conveyance line 120 and an inner wall of the stuffing box. The tool string 110 may be deployed into or retrieved from the wellbore 102 via the conveyance device 140 and/or winch conveyance device 144 through the wellhead 134, the control devices 132, and/or the sealing and alignment assembly 136.

The power and control system 150 (e.g., a control center) may be utilized to monitor and control various portions of the wellsite system 100. The power and control system 150 may be located at the wellsite surface 104 or on a structure located at the wellsite surface 104. However, the power and control system 150 may instead be located remote from the wellsite surface 104. The power and control system 150 may include a source of electrical power 152, a memory device 154, and a surface controller 156. The electrical power source 152 (e.g., a battery, an electric generator, etc.) may supply electrical power to various equipment of the wellsite system 100, including the memory device 154, the surface controller 156, the tool string 110, the conveyance device 140, and/or the winch conveyance device 144. The surface controller 156 (e.g., a processing device, a computer, etc.) may store executable programs and/or instructions, including for implementing one or more aspects of methods, processes, and operations described herein. The surface controller 156 may be communicatively connected with various equipment of the wellsite system 100, such as may permit the surface controller 156 to monitor operations of one or more portions of the wellsite system 100 and/or to provide automatic control of one or more portions of the wellsite system 100, including the electrical power source 152, the tool string 110, the conveyance device 140, and/or the winch conveyance device 144. The surface controller 156 may also or instead be used by wellsite personnel (i.e., a human operator) to manually control one or more portions of the wellsite system 100, including the tool string 110, the conveyance device 140, and/or the winch conveyance device 144. The surface controller 156 may include input devices for receiving commands from the wellsite personnel and output devices for displaying information to the wellsite personnel.

Production tubing 124 may be installed within the wellbore 102, defining an annulus 107 (i.e., an annular space) between an inner surface of the casing 108 and an outer surface of the production tubing 124. A plurality of gas lift mandrels 126 (i.e., side pocket mandrels) (only one shown) may form portions of or be connected along the production tubing 124. Each gas lift mandrel 126 may comprise a side pocket 127 laterally (or radially) offset from a main production bore 125 of the gas lift mandrel 126 and configured to receive or otherwise hold a gas lift valve 128 for injecting a gas (e.g., nitrogen) into the production tubing 124 during hydrocarbon production operations. The gas may be injected into the annulus 107 at the wellsite surface 104 via the wellhead 134 or a fluid control device 132 and transferred downhole via the annulus 107 to the gas lift valves 128. The gas may then pass into each gas lift valve 128 via an opening 129 extending through a wall of the gas lift mandrel 126 between the annulus 107 and the side pocket 127 containing the gas lift valve 128. Each gas lift valve 128 may inject the gas into the main production bore 125 of the gas lift mandrel 126 and the production tubing 124 to decrease the density of formation fluid comprising the hydrocarbons within the production tubing 124 to increase the flow of formation fluid to the wellsite surface 104. Each gas lift mandrel 126 may further comprise a receptacle 123 (e.g., a recess) or other feature within, extending into, or located on an inner surface of the gas lift mandrel 126 along the main production bore 125.

The tool string 110 may be conveyed within the wellbore 102 through the production tubing 124 to perform various intervention and other downhole operations. The tool string 110 may comprise one or more downhole tools 114 (e.g., devices, modules, subs, etc.) operable to perform such downhole operations. The conductors 122 may extend through or along at least a portion of the tool string 110, such as to communicatively and/or electrically connect one or more downhole tools 114 of the tool string 110 with the power and control system 150. The conductors 122 extending through the tool string 110 may also facilitate electrical communication between two or more tools 114. One or more of the downhole tools 114 may comprise corresponding electrical conductors, connectors, and/or interfaces forming a portion of the conductor 122 extending through the tool string 110. The conductor 122 may extend through the conveyance means 120 and externally from the conveyance means 120 at the wellsite surface 104 via a rotatable joint or coupling (e.g., a collector) (not shown) carried by the drum 146.

The tools 114 of the tool string 110 may comprise a cable head 112 (e.g., a logging head, a cable termination sub, etc.) operable to physically and/or electrically connect the conveyance means 120 with the tool string 110. The cable head 112 may thus permit the tool string 110 to be suspended and conveyed within the wellbore 102 via the conveyance means 120. The tools 114 may comprise one or more of a jarring tool, a stroker tool, and a release tool. The tools 114 may comprise a telemetry tool, such as may facilitate communication between the tool string 110 and the surface controller 156. The tools 114 may comprise one or more inclination and/or directional sensors (not shown), such as one or more accelerometers, magnetometers, gyroscopic sensors (e.g., micro-electro-mechanical system (MEMS) gyros), and/or other sensors for determining the orientation and/or direction of the tool string 110 within the wellbore 102. The tools 114 may comprise a depth correlation tool, such as a casing collar locator (CCL) tool for detecting the ends of casing collars by sensing a magnetic irregularity caused by the relatively high mass of an end of a collar of the casing 108. The depth correlation tool may also or instead be or comprise a gamma ray (GR) tool that may be utilized for depth correlation.

One or more of the tools 114 may comprise a downhole controller 113 communicatively connected with the surface controller 156 via the conductors 122 and with other portions of the tool string 110. The downhole controller 113 may be further operable to store and/or communicate to the tool string control system 150 signals or information generated by one or more sensors or instruments of the tool string 110. The downhole controller 113 may be operable to control one or more portions of the tool string 110. For example, the downhole controller 113 may be operable to receive, store, and/or process control commands from the power and control system 150 for controlling one or more tools 114 of the tool string 110.

The tool string 110 may comprise a kickover tool 116 operable to install (new) gas lift valves 128 within the side pockets 127 of the gas lift mandrels 126 and to retrieve (old) gas lift valves 128 from the side pockets 127 of the gas lift mandrels 126. The kickover tool 116 may comprise a housing 115, a latch 119, an arm 118, and a valve holder 117 connected to or otherwise carried by the arm 118. The tool string 110 (including the kickover tool 116) may be conveyed downhole to a position within the main bore 125 and adjacent the side pocket 127 of a predetermined gas lift mandrel 126. The arm 118 may then be selectively operated to extend the valve holder 117 away (e.g., laterally or radially) from the housing 115 into alignment with the side pocket 127. Extension of the arm 118 and the valve holder 117 may be triggered when the tool string 110 (including the kickover tool 126) is conveyed uphole, causing the latch 119 to engage (e.g., enter, latch against, contact, etc.) the receptacle 123 or other feature of the gas lift mandrel 126.

During gas lift valve installation operations, the valve holder 117 may initially hold a new gas lift valve 128. After the kickover tool 126 is adjacent the side pocket 127 of a predetermined gas lift mandrel 126, the arm 118 may be operated to extend the valve holder 117 and the new gas lift valve 128 away from the housing 115 into alignment with the side pocket 127. The tool string 110 (including the kickover tool 116) may then be moved downhole to install the new gas lift valve 128 into an empty side pocket 127. The tool string 110 may then be retrieved to the wellsite surface 104. During gas lift valve retrieval operations, the valve holder 117 may initially be empty. After the kickover tool 126 is adjacent the side pocket 127 of a predetermined gas lift mandrel 126, the arm 118 may be operated to extend the empty valve holder 117 away from the housing 115 into alignment with the side pocket 127 containing an old gas lift valve 128. The tool string 110 (including the kickover tool 116) may then be moved downhole to connect the empty valve holder 117 to the old gas lift valve 128 installed within the side pocket 127. The tool string 110 (including the old gas lift valve 128) may then be retrieved to the wellsite surface 104.

Figure 2:
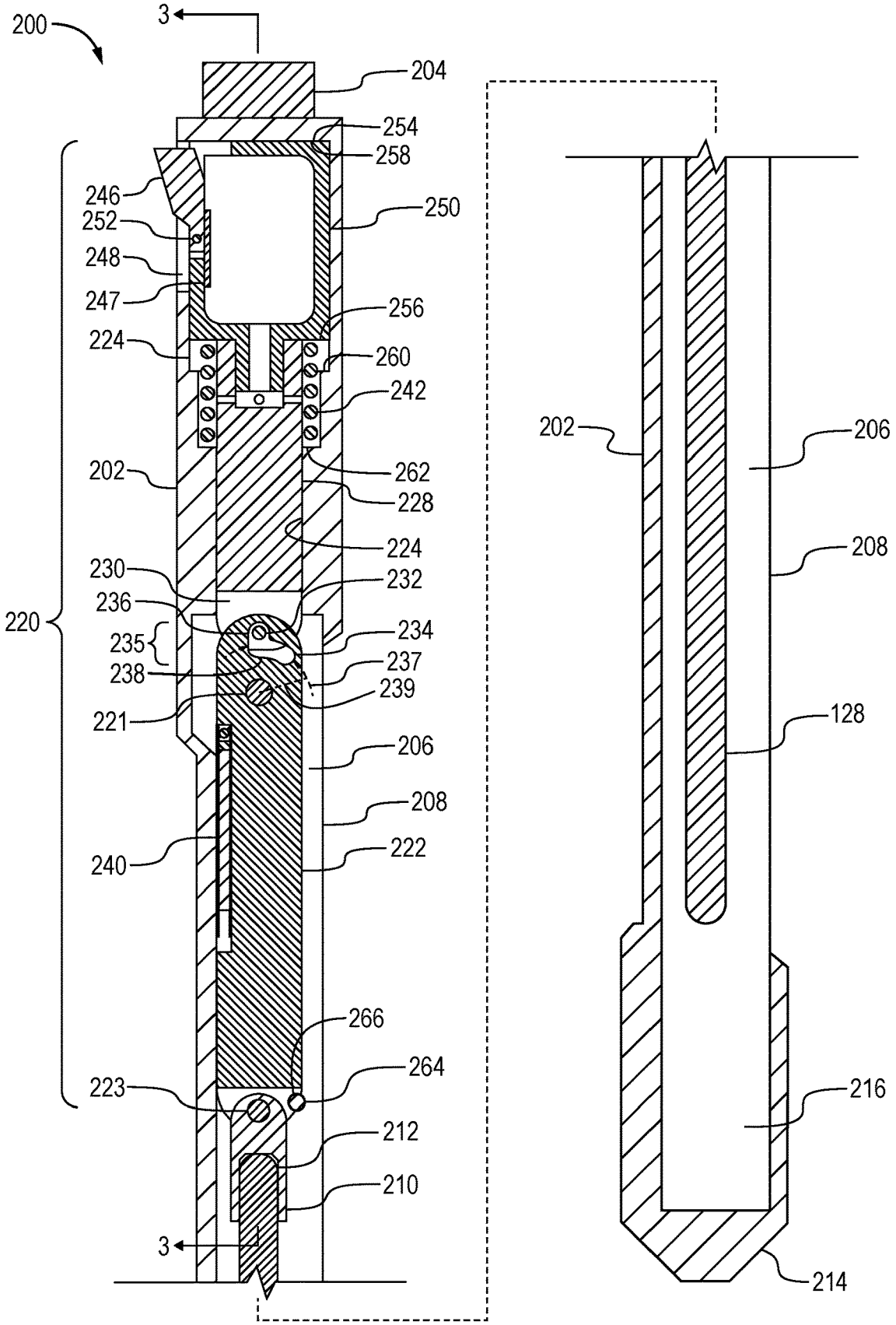
FIG. 2 is a side sectional view of at least a portion of an example implementation of apparatus according to one or more aspects of the present disclosure.
Figure 3:
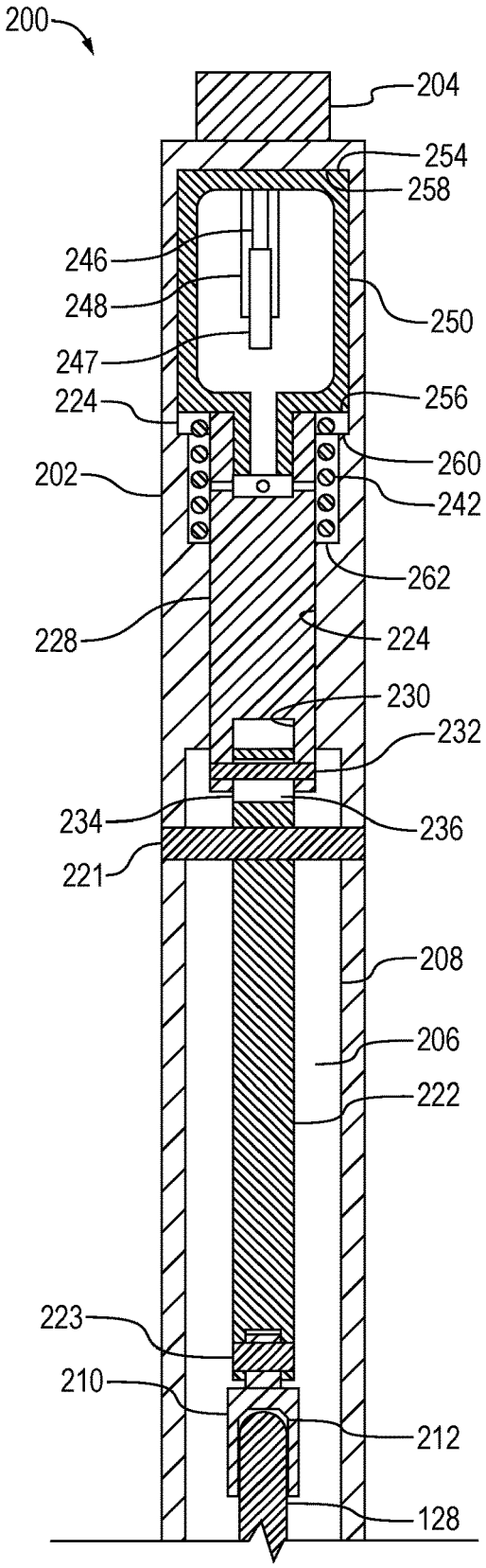
FIG. 3 is a side sectional view of a portion of the apparatus shown in FIG. 2.
Figure 4:
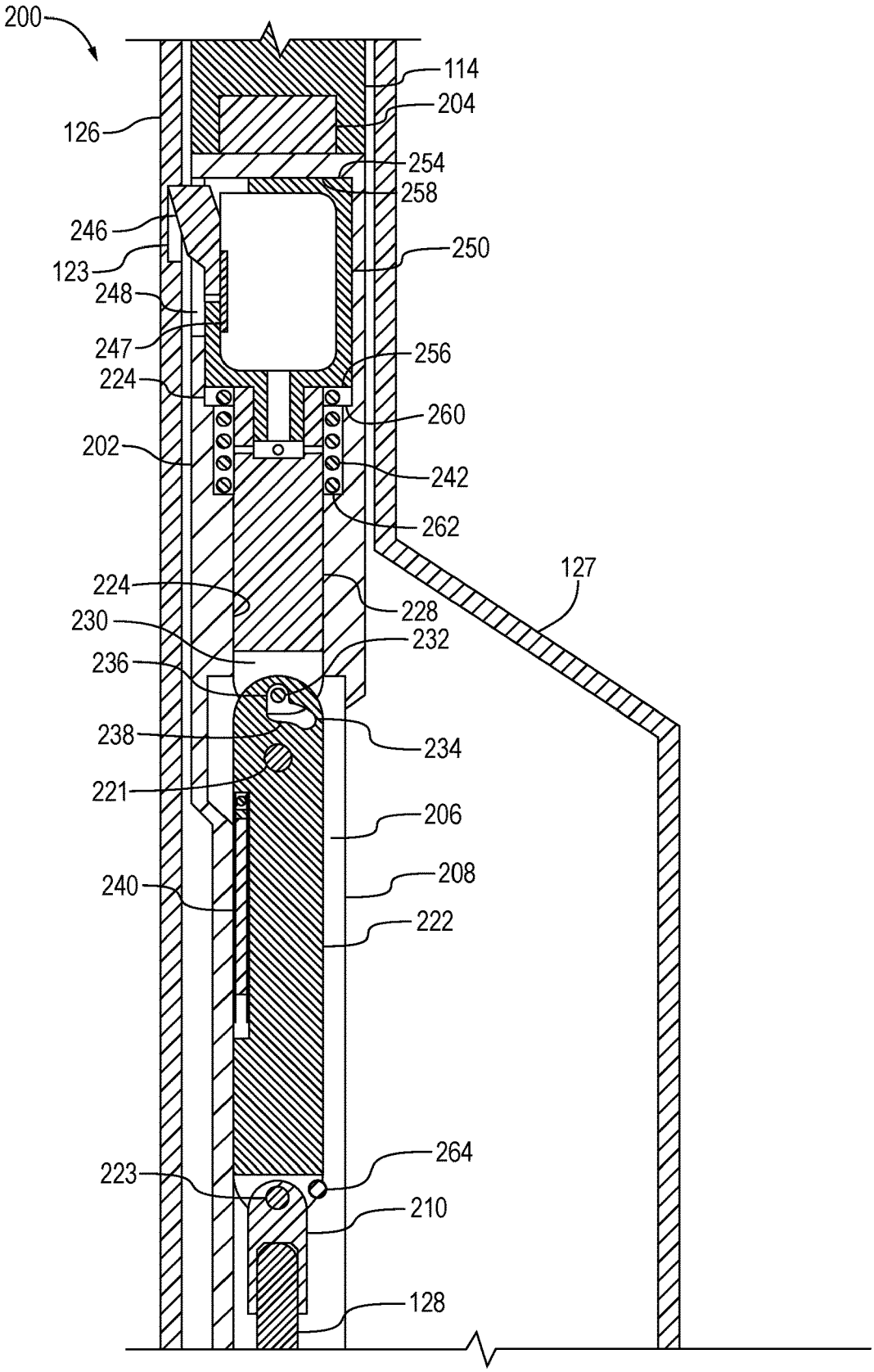
FIGS. 4-6 are side sectional views of the apparatus shown in FIG. 2 in different stages of operation according to one or more aspects of the present disclosure.
Figure 5:
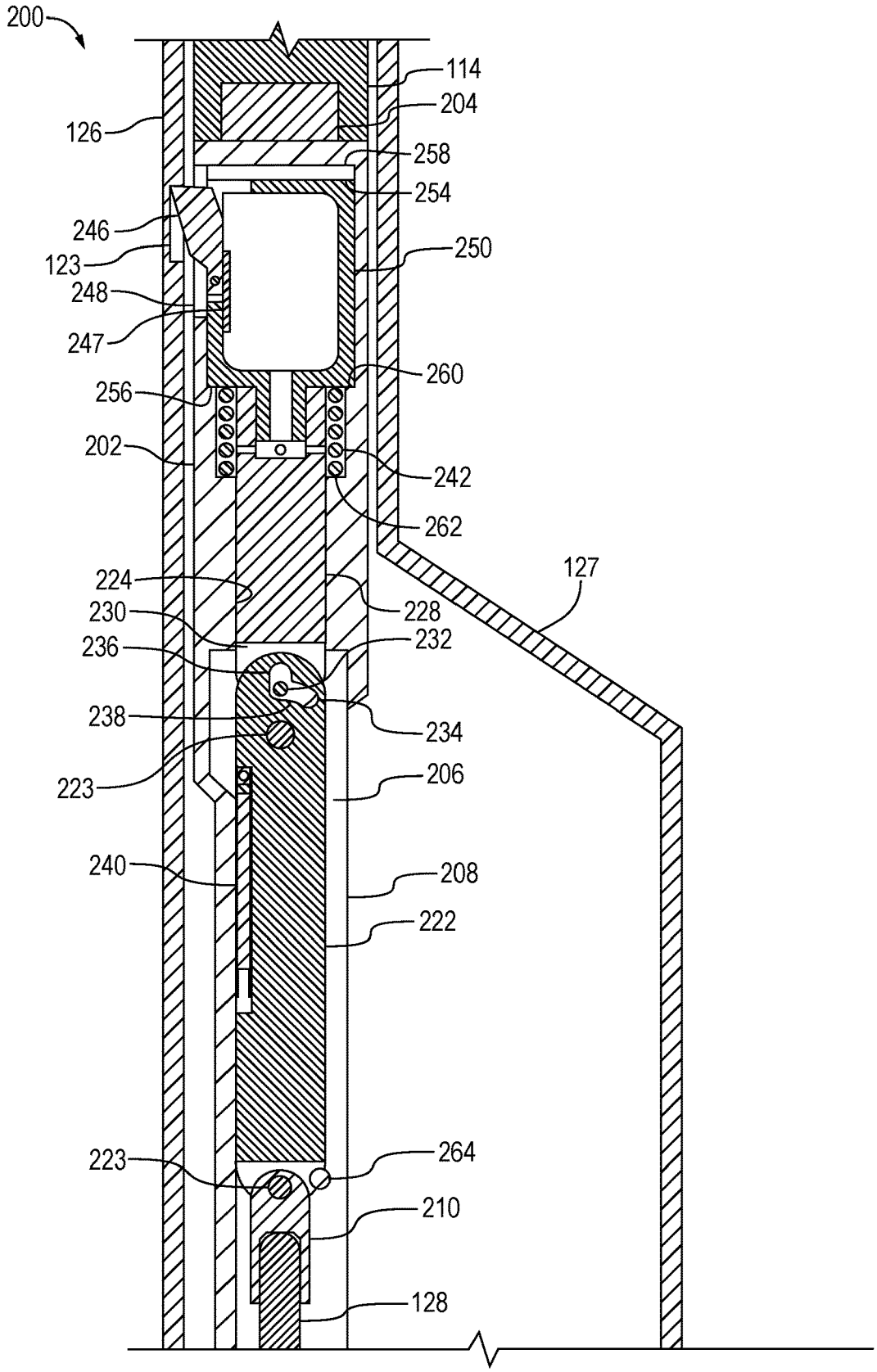
Figure 6:
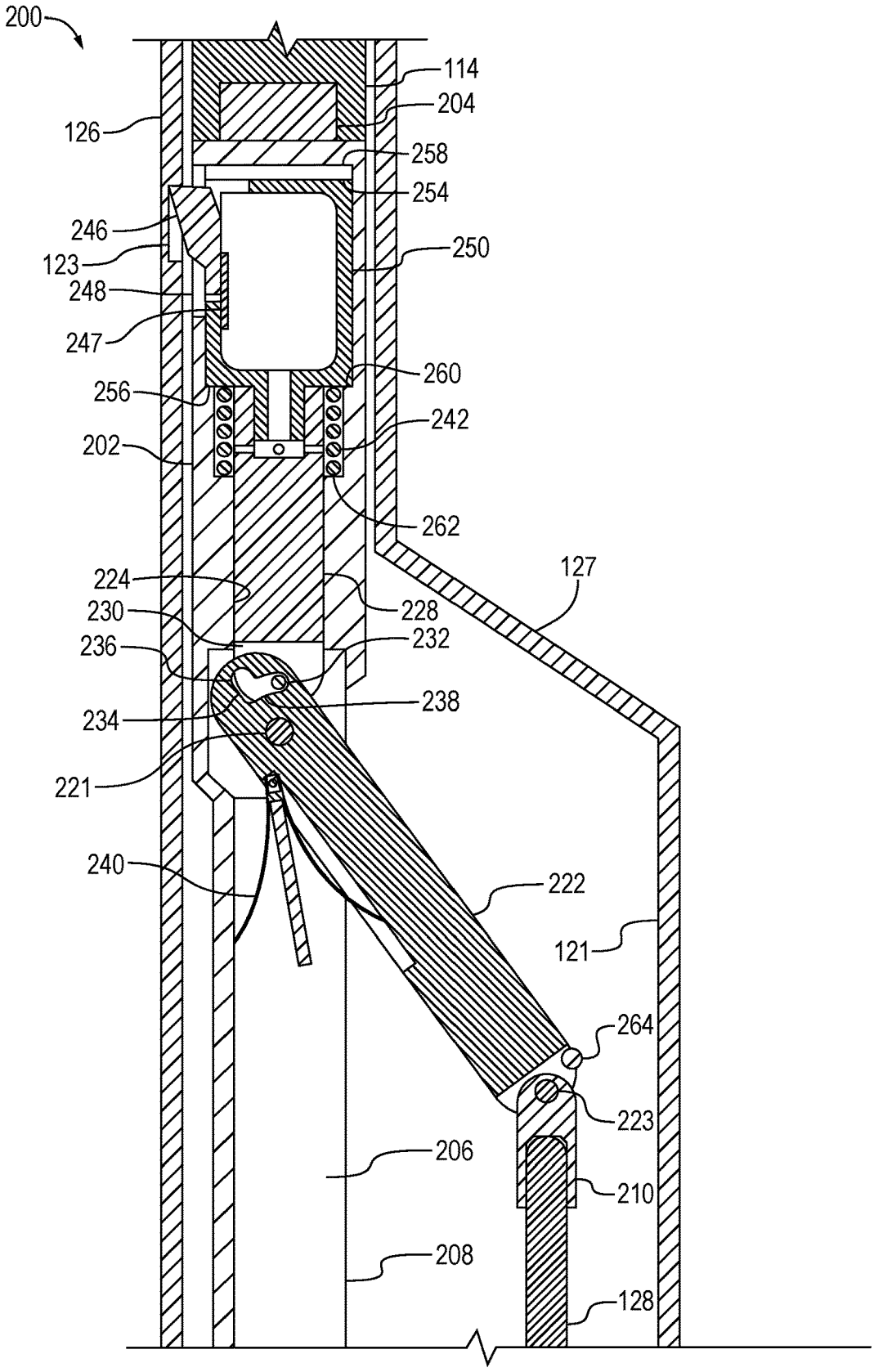

FIG. 2 is a sectional view of at least a portion of an example implementation of a kickover tool 200 according to one or more aspects of the present disclosure. FIG. 3 is another sectional view of a portion of the kickover tool 200 shown in FIG. 2, from the perspective indicated in FIG. 2. FIGS. 4-6 are sectional views of the kickover tool 200 shown in FIGS. 2 and 3 in various stages of downhole operations according to one or more aspects of the present disclosure. The kickover tool 200 may be an example implementation of the kickover tool 116 described above and shown in FIG. 1 and may comprise one or more features of the kickover tool 116. Accordingly, the following description refers to FIGS. 1-6, collectively.

The kickover tool 200 may comprise a housing (or body) 202 defining or otherwise encompassing a plurality of internal spaces or volumes containing various components of the kickover tool 200. Although the housing 202 is shown as comprising a single unitary member, it is to be understood that the housing 202 may be or comprise a housing assembly having a plurality of housing sections coupled together to form the housing 202. An upper (uphole) end of the kickover tool 200 may include an upper interface, a sub, a crossover, and/or other coupler 204 for mechanically and/or electrically coupling the kickover tool 200 with a corresponding interface (not shown) of a downhole tool 114 or other portion of a tool string 110. The coupler 204 may be a part of the housing 202 or directly or indirectly coupled with the housing 202, such as via a threaded connection.

The kickover tool 200 may further comprise a gas lift valve holder 210 (i.e., a grabber, a knuckle, etc.) configured to receive and hold a gas lift valve 128. For example, the holder 210 may comprise a receptacle 212 configured to receive and hold an end of the gas lift valve 128. The kickover tool 200 may further comprise a displacement mechanism 220 operable to move the holder 210 from a retracted (i.e., run-in) position (shown in FIGS. 2 and 4), in which the holder 210 is disposed adjacent or within the housing 202, to an extended (i.e., deployed, displaced, etc.) position (shown in FIGS. 1 and 6), in which the holder 210 is laterally (or radially) offset or otherwise disposed away (i.e., spaced away) from the housing 202.

The displacement mechanism 220 may comprise an arm 222 directly or indirectly connected with the holder 210. Although the arm 222 is shown as comprising a single unitary member, it is to be understood that the arm 222 may be or comprise an arm assembly having a plurality of arm sections coupled together to form the arm 222. The arm 222 may be pivotably connected with the housing 202 at an upper (uphole) end of the arm 222. The holder 210 may be pivotably connected with the arm 222 at a lower (downhole) end of the arm 222. The arm 222 may be pivotably connected with the housing 202 at an upper pivot point located at the upper end of the arm 222, opposite from the lower end of the arm 222 connected with the holder 210. The upper pivot point may be defined by an upper pivot pin 221 extending through at least a portion of the housing 202 and the arm 222 to pivotably connect the arm 222 to the housing 202. The holder 210 may be pivotably connected with the arm 222 at a lower pivot point located at the lower end of the arm 222, opposite from the upper end of the arm 222. The lower pivot point may be defined by a lower pivot pin 223 extending through at least a portion of the holder 210 and the arm 222 to pivotably connect the holder 210 to the arm 222.

While the displacement mechanism 220 is in the retracted position, the arm 222, the holder 210, and the gas lift valve 128 connected to the holder 210 may each be axially aligned with a longitudinal axis (e.g., a central axis) of the kickover tool 200 such that the arm 222, the holder 210, and the gas lift valve 128 are disposed adjacent to or within an open portion 206 (e.g., a cavity, a receptacle, etc.) of the housing 202. The open portion 206 of the housing 202 may comprise or be defined by an opening 208 (e.g., a slot, a channel, etc.) extending laterally (or radially) through a sidewall of the housing 202 and longitudinally along the housing 202. The open portion 206 of the housing 202 may extend below the arm 222 and the holder 210 to accommodate the gas lift valve 128 while the kickover tool 200 is conveyed within the production tubing 124 installed within the wellbore 102. A lower end 214 of the kickover tool 200 (or the housing 202) may be or comprise a receptacle 216 for catching the gas lift valve 128 when the gas lift valve 128 becomes disconnected from the holder 210 during conveyance or other operations. While the displacement mechanism 220 is in the extended position, the arm 222 may extend (i.e., protrude) laterally away from the housing 202 via the opening 208 of the open portion 206 of the housing 202 and the holder 210 may be laterally (or radially) offset from the housing 202 and axially aligned with a side pocket 127 of a gas lift mandrel 126. Such positioning may permit a new gas lift valve 128 connected to the holder 210 to be installed within an empty side pocket 127. Such positioning may also permit an empty holder 210 to couple with (e.g., grab and hold) an old gas lift valve 128 installed within the side pocket 127, thereby permitting the old gas lift valve 128 to be retrieved to the wellsite surface 104.

The kickover tool 200 may further comprise a chamber 224 within the housing 202 containing at least a portion of the displacement mechanism 220. The chamber 224 may be connected with or extend to the open portion 206 of the housing 202. The displacement mechanism 220 may further comprise a movable member 228 slidably or otherwise movably connected with or otherwise disposed with respect to the housing 202. At least a portion of the movable member 228 may be slidably or otherwise movably disposed within the chamber 224 and extend into the open portion 206 of the housing 202. The movable member 228 may be or comprise a mandrel, a rod, a shaft, or other member movably connected with or otherwise disposed with respect to the housing 202. The movable member 228 may have a generally cylindrical geometry. It is to be understood that item 228 is referred to as a "movable member" for clarity and ease of understanding because the movable member 228 is movably connected with and, thus, movable with respect to the housing 202. However, it is also to be understood that during downhole operations within the scope of the present disclosure, the movable member 228 may remain fixed or be locked in a fixed vertical position along or with respect to the wellbore 102 (e.g., the production tubing 124) while the housing 202 is vertically moved along or with respect to the wellbore 102 and the movable member 228.

The displacement mechanism 220 may further comprise a biasing means 240 disposed in association with the arm 222. The biasing means 240 may be configured to bias the arm 222 from a retracted (i.e., run-in) position (shown in FIGS. 2 and 4), in which the arm 222 extends substantially parallel to or longitudinally along or within the housing 202, toward an extended (i.e., deployed, pivoted, etc.) position (shown in FIGS. 1 and 6), in which the arm 222 extends laterally (e.g., diagonally) away from or otherwise with respect to the housing 202. The arm 222 may be operable to move the holder 210 from its retracted position to its extended position, such that when the arm 222 is in its retracted position, the holder 210 is also in its retracted position, and when the arm 222 is in its extended position, the holder 210 is also in its extended position. The biasing means 240 may comprise a plurality of leaf springs, each disposed on an opposing side of a backing member. While the arm 222 is in its retracted position, one or more of the leaf springs may push against the backing member and the housing 202, and other one or more of the leaf springs may push against the backing member and the arm 222 to therefore collectively bias the arm 222 from its retracted position toward its extended position during the gas lift valve installation or retrieval operations. The biasing means 240 may instead comprise a coiled spring disposed in association with (e.g., within, around, etc.) telescoping guide members collectively operable to stabilize the coiled spring along its central axis while the coiled spring is compressed. While the arm 222 is in its retracted position, one end of the coiled spring may push against the housing 202 and the other end of the coiled spring may push against the arm 222 to therefore bias the arm 222 from its retracted position toward its extended position during the gas lift valve installation or retrieval operations.

The movable member 228 and the arm 222 may be mechanically or otherwise operatively connected and relatively movable between a first relative position in which the movable member 228 prevents the arm 222 from pivoting from its retracted position to its extended position and a second relative position in which the movable member 228 permits the arm 222 to pivot from its retracted position to its extended position. For example, the movable member 228 and the arm 222 may each be configured to engage while in the first relative position to prevent the arm 222 from pivoting from its retracted position to its extended position and to disengage while in the second relative position to permit the arm 222 to pivot from its retracted position to its extended position. Thus, relative movement between the movable member 228 and the arm 222 may cause the movable member 228 and the arm 222 to engage, preventing the arm 222 from pivoting from its retracted position to its extended position, and to disengage, permitting the arm 222 to pivot from its retracted position to its extended position.

A lower end of the movable member 228 may comprise a pin 232 (e.g., a key, a protrusion, a circular outer profile, etc.) extending therefrom. The lower end of the movable member 228 may comprise a slit 230 extending longitudinally and laterally through the movable member 228. The pin 232 may extend through the lower end of the movable member 229 across the slit 230. The arm 222 may comprise a curved (or deviated) slot 234 (e.g., a curved channel, a curved receptacle, a curved inner profile, etc.) configured to receive the pin 232. The pin 232 and the slot 234 may collectively be or form a pin-slot joint 235 (also known as a pin-in-slot joint).

The curved slot 234 may comprise a first slot portion 236 and a second slot portion 238 connected to each other and extending laterally (e.g., diagonally, perpendicularly, etc.) or otherwise at an angle with respect to each other. The first slot portion 236 may extend along a longitudinal axis of the arm 222 and the second slot portion 238 may extend laterally (e.g., diagonally, perpendicularly, etc.) or otherwise at an angle with respect to the longitudinal axis of the arm 222. The second slot portion 238 may extend partially around the pivot point defined by the pivot pin 221. For example, the second slot portion 238 may extend circumferentially around the pivot point by or along a predetermined angle 237 (i.e., angular distance), starting at an initial angle (e.g., zero degrees) aligned with the first slot portion 236, and terminating at the predetermined angle 237 around the pivot point. The second slot portion 238 may thus comprise a radius 239 extending to the pivot point. The curved slot 234 may extend through (penetrate) the arm 222 and accommodate the pin 232 therethrough (or contain the pin therein). The slot 234 may be located at an upper end of the arm 222 above the pivot pin 221, such that the pivot pin 221 is located between the slot 234 and the holder 210. The upper end of the arm 222 may be disposed within the slit 230 of the movable member 228 such that the pin 232 is disposed within the slot 234.

The movable member 228 and the arm 222 may be mechanically or otherwise operatively connected via the pin-slot joint 235 and relatively movable between a first relative position in which the pin-slot joint 235 prevents the arm 222 from pivoting from its retracted position to its extended position and a second relative position in which the pin-slot joint 235 permits the arm 222 to pivot from its retracted position to its extended position. Thus, during different stages of downhole operations, the movable member 228 and the arm 222 may be movable with respect to each other to permit, cause, or otherwise facilitate relative movement between the pin 232 and the slot 234 of the pin-slot joint 235 to thereby control position of the arm 222. For example, when the movable member 228 and the arm 222 are moved away from each other (e.g., the movable member 228 moves upward (uphole) away from the arm 222), the pin 232 and the first slot portion 236 may engage (e.g., latch, mesh, interlock, etc.). In such position, the pin 232 may be disposed within the first slot portion 236 such that the side walls of the first slot portion 236 contact the pin 232. In such position, the pin 232 latches the arm 222 and prevents the arm 222 from pivoting from its retracted position to its extended position. However, when the movable member 228 and the arm 222 are moved toward each other (e.g., the movable member 228 moves downward (downhole) toward the arm 222), the pin 232 and the first slot portion 236 may disengage, whereby the pin moves out of the first slot portion 236 into the second slot portion 238. In such position, the pin 232 does not prevent the arm 222 from pivoting, thereby permitting the biasing means 240 to pivot the arm 222 about the pivot pin 221 from its retracted position to its extended position. While the arm 222 pivots about the pivot pin 221, the pin 232 moves along the second slot portion 238 until the pin 232 reaches the end of the second slot portion 238, causing the arm 222 to stop pivoting. The angle 237 through which the first slot portion 236 extends around the pivot pin 221 limits the angle through which the arm 222 pivots to reach its extended position. For example, if the first slot portion 236 extends 30 degrees around the pivot pin 221, the arm 222 may also pivot 30 degrees from its retracted position to its extended position.

The displacement mechanism 220 may further comprise a biasing member 242 (e.g., a coiled spring) movably or otherwise operatively connecting the housing 202 with the movable member 228 and, thus, also operatively connecting the housing 202 with the arm 222. For example, the biasing member 242 may bias the movable member 228 upward with respect to the arm 222 and, thus, bias the movable member 228 against or into contact with the arm 222 to therefore engage the movable member 228 with the arm 222. For example, the biasing member 242 may bias the pin 232 of the movable member 228 upward such that the pin 232 engages (e.g., enters, meshes with, interlocks with, connects with, etc.) the first slot portion 236 of the slot 234 while the arm 222 is in its retracted position. As described above, while the pin 232 of the movable member 228 engages the first slot portion 236 of the slot 234, the pin 232 latches the arm 222 in its retracted position, preventing the arm 222 from pivoting to its extended position. Accordingly, the first slot portion 236 of the slot 234 may be or operate as a detent (or receptacle) and the pin 232 may be or operate as a follower, collectively preventing the arm 222 from pivoting when the pin 232 engages (is disposed within) the first slot portion 236 and permitting the arm 222 to pivot when the pin 232 disengages (exits) the first slot portion 236 and moves into the second slot portion 238.

The displacement mechanism 220 may further comprise a latch (e.g., a trigger) 246 directly or indirectly connected with the movable member 228. The latch 246 may be biased by a biasing member (e.g., a leaf spring) 247 to extend out of the housing 202 through a slot opening 248 in the housing 202. The latch 246 may be configured to engage (e.g., enter, lock with, latch against, etc.) a receptacle 123 along a main bore 125 of a gas lift mandrel 126 while the kickover tool 200 moves through the main bore 125 of the gas lift mandrel 126. The latch 246 may be connected to the movable member 228 via an intermediate movable member 250 slidably disposed within the chamber 224 of the housing 202. The latch 246 may be pivotably connected with the intermediate movable member 250 at a pivot point defined by a pivot pin 252, permitting the latch 246 to be forced or otherwise moved into the chamber 224 via the slot opening 248.

The intermediate movable member 250 may be threadedly or otherwise fixedly connected with the movable member 228, such as may permit the movable members 228, 250 to move as a single member or otherwise in unison within the chamber 224. The intermediate movable member 250 may comprise opposing upper and lower shoulders (e.g., flanges) 254, 256 having larger outer diameters than the movable member 228. The shoulders 254, 256 may be configured to abut corresponding shoulders 258, 260 or other surfaces of the housing 202 to limit movement of the movable members 228, 250 within the chamber 224 and, thus, with respect to the housing 202 and the arm 222. The biasing member 242 may be disposed within the chamber 224 and extend around the movable member 228. The biasing member 242 may be compressed between a shoulder 262 of the housing 202 and the shoulder 256 of the intermediate movable member 250, thereby applying an upward biasing force to the movable members 228, 250 with respect to the housing 202 and the arm 222. As described above, the biasing member 242 applies an upward biasing force to the pin 232 connected to the movable member 228, biasing the pin 232 to remain engaged with (disposed within) the first slot portion 236 in the arm 222.

Although the movable member 228 is shown and described as comprising the pin 232 and the arm 222 is shown and described as comprising the slot 234, it is to be understood that in a different implementation of the kickover tool within the scope of the present disclosure, the movable member 228 may comprise a curved slot (e.g., a channel, a receptacle, etc.), such as the curved slot 234, and the arm 222 may comprise a follower pin (e.g., a key, a protrusion, etc.), such as the pin 232. For example, the upper end of the arm 222 may comprise a slit and the follower pin extending across the slit. A lower end of the movable member 228 may comprise the curved (or deviated) slot accommodating the follower pin. The lower end of the movable member 228 may be disposed within the slit of the arm 222 such that the follower pin is disposed within the curved slot. The curved slot may comprise a first slot portion extending along a longitudinal axis of the movable member 228 and a second slot portion extending laterally (e.g., diagonally, perpendicularly, etc.) with respect to the longitudinal axis of the movable member 228. The second slot portion may extend partially around the pivot point of the arm 222 defined by the pivot pin 221 when the follower pin is located within the second slot portion. For example, the second slot portion may extend circumferentially around the pivot point by or along a predetermined angle (i.e., angular distance), starting at an initial angle (e.g., zero degrees) aligned with the first slot portion, and terminating at the predetermined angle around the pivot point. The second slot portion may thus comprise a radius extending to the pivot point. The curved slot may extend through (penetrate) the movable member 228 and accommodate the follower pin therethrough. The follower pin may be located at an upper end of the arm 222 above the pivot pin 221, such that the pivot pin 221 is located between the follower pin and the holder 210.

A rotating member 264 (e.g., a roller, a wheel, a ball bearing, etc.) or other friction reducing member (e.g., a friction reducing plate) may be rotatably connected to or otherwise carried by the arm 222, such as to reduce friction between the arm 222 and an inner surface of the production tubing 124 after the arm 222 pivots to its extended position. The rotating member 264 may project or extend past an outer surface of the arm 222 and be located at a lower end of the arm 222 to facilitate contact with the production tubing 124 after the arm 222 pivots to its extended position. The rotating member 264 may be disposed within a cavity 266 in the arm 222 or the rotating member 264 may be connected with the arm 222 via a bracket or base (not shown) connected to or otherwise extending from the arm 222. The rotating member 264 may comprise a spherical geometry or a cylindrical geometry. The rotating member 264 may be one of a plurality of rotating members 264 rotatably connected to or otherwise carried by the arm 222.

The present disclosure is further directed to methods of using or operating the kickover tool 200 to install a new gas lift valve 128 into the side pocket 127 of a gas lift mandrel 126 located along the production tubing 124 within the wellbore 102 and to retrieve an old (or used) gas lift valve 128 from the side pocket 127 of a gas lift mandrel 126. For example, to install the new gas lift valve 128, a tool string 110 comprising the kickover tool 200 carrying the new gas lift valve 128 may be conveyed within the production tubing 124, while the holder 210 with the new gas lift valve 128 is in its retracted position, until the kickover tool 200 is disposed within an intended gas lift mandrel 126 in which the new gas lift valve 128 is to be installed. The kickover tool 200 may be conveyed downhole until the latch 246 is located adjacent to or below the receptacle 123 along the sidewall of the gas lift mandrel 126. The tool string 110 may then be pulled uphole until the latch 246 engages (e.g., enters, latches against, etc.) the receptacle 123, as shown in FIG. 4, thereby locking in position the latch 246 and other portions of the displacement mechanism 220 connected with the latch 246, including the movable members 228, 250.

The tool string 110 may be pulled further uphole to trigger the displacement mechanism 220 to cause the holder 210 and the new gas lift valve 128 to move to the extended position and, thus, permit the new gas lift valve 128 to be installed within the side pocket 127 of the gas lift mandrel 126. As shown in FIG. 5, pulling of the kickover tool 200 uphole causes the housing 202 to move uphole while the movable members 228, 250 remain in a static vertical position (i.e., at a static depth) with respect to the gas lift mandrel 126, thereby compressing the biasing means 242 between the housing 202 and the movable member 250. Because the arm 222 is connected with the housing 202, uphole movement of the housing 202 causes the arm 222 to move in the uphole direction with respect to the movable member 228, thereby causing the pin 232 of the movable member 228 to progressively disengage (i.e., exit) the first slot portion 236 and move into the second slot portion 238. The housing 202 and the arm 222 may continue to move uphole until the shoulder 256 of the intermediate movable member 250 contacts the shoulder 260 of the housing 202. At such position, the pin 232 of the movable member 228 fully disengages the first slot portion 236 and enters into the second slot portion 238.

As shown in FIG. 6, when the pin 232 of the movable member 228 fully disengages the first slot portion 236 and enters the second slot portion 238, the pin 232 no longer prevents the arm 222 from pivoting, thereby permitting the biasing means 240 to pivot the arm 222 and the holder 210 with the new gas lift valve 128 toward their extended position within the side pocket 127. While the arm 222 and the holder 210 move toward their extended position, the holder 210 and the new gas lift valve 128 may pivot into alignment with the side pocket 127 via contact of the holder 210 and/or the new gas lift valve 128 with a sidewall 121 of the side pocket 127, causing the holder 210 and the new gas lift valve 128 to pivot into alignment with the side pocket 127.

When the arm 222 and the holder 210 reach their extended position and the holder 210 and the new gas lift valve 128 are aligned with the side pocket 127, the tool string 110 may then be moved downhole to insert the new gas lift valve 128 within the side pocket 127. After the new gas lift valve 128 is inserted within the side pocket 127, the tool string 110 may be conveyed to the wellsite surface 104 via the production tubing 124. Another new gas lift valve 128 may then be connected with the holder 210 and the tool string 110 may again be conveyed downhole to another gas lift mandrel 126 to install the new gas lift valve 128. While the tool string 110 is conveyed to the wellsite surface 104, the arm 222 may still be extended and, thus, contact the inner surface of the production tubing 124. The rotatable member 264 may contact and roll along the inner surface of the production tubing 124 to reduce friction between the arm 222 and the production tubing 124.

When the kickover tool 200 reaches the wellsite surface 104, a new gas lift valve 128 may be connected with the holder 210, and the arm 222 and the holder 210 may be moved to their retracted position by performing displacement mechanism resetting operations. During such resetting operations, the pin 232 and the first slot portion 236 may be engaged by pivoting the arm 222 from its extended position to its retracted position until the pin 232 engages (e.g., moves onto) the first slot portion 236. Such operations may be performed manually by hand, without the use of hand or other mechanical tools. During the resetting operations, the arm 222 may be manually pivoted toward its retracted position by overcoming the force of the biasing means 240. During the resetting operations, the biasing member 242 may force (e.g., pull) the movable member 228 upward, thereby causing the pin 232 to slide along a sidewall of the second slot portion 238 while the arm 222 is being rotated. When the arm 222 reaches its retracted position, the pin 232 may engage (move into) the first slot portion 236, engaging the arm 222 with the movable member 228 to prevent the arm 222 from pivoting back to its extended position.

To retrieve an old gas lift valve 128 from a side pocket 127 of a gas lift mandrel 126, the operations or actions described above may be performed, but without a gas lift valve 128 connected to the holder 210. For example, the kickover tool 200 with an empty holder 210 may be conveyed within the production tubing 124, while the empty holder 210 is in a retracted position, until the kickover tool 200 is disposed within an intended gas lift mandrel 126 in which the old gas lift valve 128 is installed. Thereafter, the tool string 110 may be pulled uphole until the latch 246 engages the receptacle 123 and the displacement mechanism 220 moves the arm 222 and the holder 210 to their extended position and into alignment with the old gas lift valve 128 within the side pocket 127. Thereafter, the tool string 110 may be moved downhole to connect the holder 210 with the old gas lift valve 128. The tool string 110 may then be pulled uphole to remove the old gas lift valve 128 from the side pocket 127 and conveyed back to the wellsite surface 104.

When the old gas lift valve 128 is stuck within the side pocket 127, a jarring tool (i.e., an impact jar) coupled within the tool string 110 above the kickover tool 200 may be utilized to impart one or more impacts to the stuck old gas lift valve 128 to free the stuck old gas lift valve 128. Because the jarring tool is located uphole from the kickover tool 200, the impact force will be transferred from the jarring tool to the stuck old gas lift valve 128 via the housing 202, the arm 222, and the holder 210 of the kickover tool 200.

When the tool string 110 with the kickover tool 200 reaches the wellsite surface 104, the arm 222 and the holder 210 are in their extended position. The old gas lift valve 128 may be disconnected from the holder 210, and the arm 222 and the empty holder 210 may be moved to their retracted position by performing the displacement mechanism resetting operations. The tool string 110 may then again be conveyed downhole to retrieve another old gas lift valve 128.

In view of the entirety of the present disclosure, including the figures and the claims, a person having ordinary skill in the art will readily appreciate that the present disclosure introduces an apparatus comprising a downhole tool for installing a gas lift valve in a well, wherein the downhole tool comprises a housing, a mandrel movably disposed with respect to the housing, a holder configured to hold the gas lift valve, and an arm supporting the holder. The arm is operable to pivot between a retracted position in which the holder is adjacent the housing and an extended position in which the holder is disposed away from the housing. The mandrel and the arm are operatively connected via a pin-slot joint comprising a pin disposed within a slot. The slot comprises a first slot portion and a second slot portion. The pin-slot joint prevents the arm from pivoting when the pin is within the first slot portion. The pin-slot joint permits the arm to pivot when the pin is within the second slot portion.

The arm may comprise the slot and the mandrel may comprise the pin. The first slot portion may extend longitudinally along the arm. The second slot portion may extend laterally with respect to a longitudinal axis of the arm. The arm may be pivotably connected with the housing at a pivot point, and the second slot portion may extend partially around the pivot point.

The second slot portion may be curved.

The first slot portion and the second slot portion may extend at an angle with respect to each other.

The arm may be pivotably connected with the housing at a pivot point, and the pivot point may be located between the slot and the holder.

The arm may be pivotably connected with the housing, and the downhole tool may further comprise a biasing member operable to bias the mandrel and the housing toward a predetermined relative position causing the pin to be maintained within the first slot portion to thereby prevent the arm from pivoting from the retracted position to the extended position.

The downhole tool may further comprise a biasing member disposed in association with the arm, and the biasing member may be operable to pivot the arm from the retracted position to the extended position when the pin is within the second slot portion.

Relative movement between the mandrel and the housing may cause the pin to move out of the first slot portion and into the second slot portion, thereby permitting the arm to pivot from the retracted position to the extended position.

The present disclosure also introduces an apparatus comprising a downhole tool for installing a gas lift valve in a well, wherein the downhole tool comprises a housing, a mandrel movably disposed with respect to the housing, a first biasing member, a second biasing member, an arm pivotably connected to the housing, and a holder connected to the arm and configured to hold the gas lift valve. The arm is operable to pivot between a retracted position in which the holder is adjacent the housing and an extended position in which the holder is disposed away from the housing. The mandrel and the arm are operatively connected via a pin-slot joint comprising a pin disposed within a slot. The slot comprises a first slot portion and a second slot portion. The first slot portion and the second slot portion extend at an angle with respect to each other. The first biasing member is operable to bias the mandrel and the housing toward a predetermined relative position causing the pin to be maintained within the first slot portion to thereby prevent the arm from pivoting from the retracted position to the extended position. The second biasing member is operable to pivot the arm from the retracted position to the extended position when the pin is within the second slot portion.

The arm may comprise the slot and the mandrel may comprise the pin. The first slot portion may extend along a longitudinal axis of the arm, and the second slot portion may extend laterally with respect to the longitudinal axis of the arm. The second slot portion may be curved.

The present disclosure also introduces an apparatus comprising a downhole tool for installing a gas lift valve in a well, wherein the downhole tool comprises a housing, a mandrel movably disposed with respect to the housing, a holder configured to hold the gas lift valve, and an arm supporting the holder. The arm is operable to pivot between a retracted position in which the holder is adjacent the housing and an extended position in which the holder is disposed away from the housing. The arm comprises a slot having a first slot portion and a second slot portion. The mandrel comprises a pin disposed within the slot. The pin prevents the arm from pivoting from the retracted position to the extended position when the pin is within the first slot portion.

The first slot portion and the second slot portion may extend at an angle with respect to each other.

The first slot portion may extend along a longitudinal axis of the arm, and the second slot portion may extend laterally with respect to the longitudinal axis of the arm.

The arm may be pivotably connected with the housing at a pivot point, and the pivot point may be located between the slot and the holder.

The arm may be pivotably connected with the housing, and the downhole tool may further comprise a biasing member operable to bias the mandrel and the housing toward a predetermined relative position causing the pin to be maintained within the first slot portion to thereby prevent the arm from pivoting from the retracted position to the extended position.

The foregoing outlines features of several embodiments so that a person having ordinary skill in the art may better understand the aspects of the present disclosure. A person having ordinary skill in the art should appreciate that they may readily use the present disclosure as a basis for designing or modifying other processes and structures for carrying out the same purposes and/or achieving the same advantages of the embodiments introduced herein. A person having ordinary skill in the art should also realize that such equivalent constructions do not depart from the scope of the present disclosure, and that they may make various changes, substitutions and alterations herein without departing from the scope of the present disclosure.

The Abstract at the end of this disclosure is provided to permit the reader to quickly ascertain the nature of the technical disclosure. It is submitted with the understanding that it will not be used to interpret or limit the scope or meaning of the claims.

What is claimed is:

1. An apparatus comprising:

a downhole tool for installing a gas lift valve in a well, wherein the downhole tool comprises:

a housing;

a movable member movably disposed with respect to the housing;

a holder configured to hold the gas lift valve; and an arm supporting the holder, wherein:

the arm is operable to pivot between a retracted position in which the holder is adjacent the housing and an extended position in which the holder is disposed away from the housing;

the movable member and the arm are operatively connected via a pin-slot joint comprising a pin disposed within a slot;

the slot comprises a first slot portion and a second slot portion;

the pin and the slot move with respect to each other such that the pin is within the first slot portion when the arm is in the retracted position and the pin is within the second slot portion when the arm is in the extended position;

the pin-slot joint prevents the arm from pivoting from the retracted position to the extended position when the pin is within the first slot portion; and the pin-slot joint permits the arm to pivot when the pin is within the second slot portion.

2. The apparatus of claim 1 wherein the arm comprises the slot and the movable member comprises the pin.

3. The apparatus of claim 2 wherein the first slot portion extends longitudinally along the arm.

4. The apparatus of claim 2 wherein the second slot portion extends laterally with respect to a longitudinal axis of the arm.

5. The apparatus of claim 2 wherein the arm is pivotably connected with the housing at a pivot point, and wherein the second slot portion extends partially around the pivot point.

6. The apparatus of claim 1 wherein the second slot portion is curved.

7. The apparatus of claim 1 wherein the first slot portion and the second slot portion extend at an angle with respect to each other.

8. The apparatus of claim 1 wherein the arm is pivotably connected with the housing at a pivot point, and wherein the pivot point is located between the slot and the holder.

9. The apparatus of claim 1 wherein the arm is pivotably connected with the housing, and wherein the downhole tool further comprises a biasing member operable to bias the movable member and the housing toward a predetermined relative position causing the pin to be maintained within the first slot portion to thereby prevent the arm from pivoting from the retracted position to the extended position.

10. The apparatus of claim 1 wherein the downhole tool further comprises a biasing member disposed in association with the arm, and wherein the biasing member is operable to pivot the arm from the retracted position to the extended position when the pin is within the second slot portion.

11. The apparatus of claim 1 wherein relative movement between the movable member and the housing causes the pin to move out of the first slot portion and into the second slot portion, thereby permitting the arm to pivot from the retracted position to the extended position.

12. An apparatus comprising:

a downhole tool for installing a gas lift valve in a well, wherein the downhole tool comprises:

a housing;

a movable member movably disposed with respect to the housing;

a first biasing member;

a second biasing member;

an arm pivotably connected to the housing; and a holder connected to the arm and configured to hold the gas lift valve, wherein:

the arm is operable to pivot between a retracted position in which the holder is adjacent the housing and an extended position in which the holder is disposed away from the housing;

the movable member and the arm are operatively connected via a pin-slot joint comprising a pin disposed within a slot;

the slot comprises a first slot portion and a second slot portion;

the first slot portion and the second slot portion extend at an angle with respect to each other;

the pin and the slot move with respect to each other such that the pin is within the first slot portion when the arm is in the retracted position and the pin is within the second slot portion when the arm is in the extended position;

the first biasing member is operable to bias the movable member and the housing toward a predetermined relative position causing the pin to be maintained within the first slot portion to thereby prevent the arm from pivoting from the retracted position to the extended position; and the second biasing member is operable to pivot the arm from the retracted position to the extended position when the pin is within the second slot portion.

13. The apparatus of claim 12 wherein the arm comprises the slot and the movable member comprises the pin.

14. The apparatus of claim 13 wherein the first slot portion extends along a longitudinal axis of the arm, and wherein the second slot portion extends laterally with respect to the longitudinal axis of the arm.

15. The apparatus of claim 13 wherein the second slot portion is curved.

16. An apparatus comprising:

a downhole tool for installing a gas lift valve in a well, wherein the downhole tool comprises:

a housing;

a movable member movably disposed with respect to the housing;

a holder configured to hold the gas lift valve; and an arm supporting the holder, wherein:

the arm is operable to pivot between a retracted position in which the holder is adjacent the housing and an extended position in which the holder is disposed away from the housing;

the arm comprises a slot having a first slot portion and a second slot portion;

the movable member comprises a pin disposed within the slot;

the pin and the slot move with respect to each other such that the pin is within the first slot portion when the arm is in the retracted position and the pin is within the second slot portion when the arm is in the extended position; and the pin prevents the arm from pivoting from the retracted position to the extended position when the pin is within the first slot portion.

17. The apparatus of claim 16 wherein the first slot portion and the second slot portion extend at an angle with respect to each other.

18. The apparatus of claim 16 wherein the first slot portion extends along a longitudinal axis of the arm, and wherein the second slot portion extends laterally with respect to the longitudinal axis of the arm.

19. The apparatus of claim 16 wherein the arm is pivotably connected with the housing at a pivot point, and wherein the pivot point is located between the slot and the holder.

20. The apparatus of claim 16 wherein the arm is pivotably connected with the housing, and wherein the downhole tool further comprises a biasing member operable to bias the movable member and the housing toward a predetermined relative position causing the pin to be maintained within the first slot portion to thereby prevent the arm from pivoting from the retracted position to the extended position.

* * * * *